US008522919B2

(12) United States Patent
Flux

(10) Patent No.: US 8,522,919 B2
(45) Date of Patent: Sep. 3, 2013

(54) TWO-WAY LOCKING DEVICE FOR HEIGHT SAFETY APPARATUS

(75) Inventor: Peter Robert Flux, Inverness-Shire (GB)

(73) Assignee: Latchways PLC, Wiltshire (GB)

( * ) Notice: Subject to any disclaimer, the term of this patent is extended or adjusted under 35 U.S.C. 154(b) by 1267 days.

(21) Appl. No.: 10/517,952

(22) PCT Filed: Jun. 13, 2003

(86) PCT No.: PCT/GB03/02575

§ 371 (c)(1),
(2), (4) Date: Jun. 16, 2005

(87) PCT Pub. No.: WO03/105960

PCT Pub. Date: Dec. 24, 2003

(65) Prior Publication Data

US 2005/0269160 A1 Dec. 8, 2005

(30) Foreign Application Priority Data

Jun. 14, 2002 (GB) ..... 0213744.6

(51) Int. Cl.
*E04G 3/28* (2006.01)

(52) U.S. Cl.
USPC ..... 182/36; 104/115; 104/182

(58) Field of Classification Search
USPC ..... 182/36; 104/115, 182
See application file for complete search history.

(56) References Cited

U.S. PATENT DOCUMENTS

| | | | | | |
|---|---|---|---|---|---|
| 1,959,722 | A * | 5/1934 | Lackner | 24/134 P |
| 2,035,446 | A * | 3/1936 | Barrett | 24/132 R |
| 2,925,240 | A * | 2/1960 | Laviolette | 248/323 |
| 4,352,330 | A * | 10/1982 | Tupper | 104/96 |
| 4,846,075 | A * | 7/1989 | Tupper | 104/209 |
| 6,530,454 | B1 * | 3/2003 | Renton et al. | 182/36 |
| 6,945,357 | B1 * | 9/2005 | Flux | 182/36 |
| 7,007,772 | B2 * | 3/2006 | Argoud | 182/36 |

FOREIGN PATENT DOCUMENTS

| | | |
|---|---|---|
| EP | 0 272 782 A1 | 6/1988 |
| GB | 2 096 959 A | 10/1982 |
| WO | WO 00/24471 A1 | 5/2000 |

* cited by examiner

*Primary Examiner* — Katherine Mitchell
*Assistant Examiner* — Candace L Bradford
(74) *Attorney, Agent, or Firm* — Gordon & Jacobson, PC

(57) ABSTRACT

A fall arrest device having a safety support whilst allowing movement of the device on an elongate support. The fall arrest device including, a sliding element, first and second cam elements, first and second links, and an attachment. The first and second links connected together to mutually rotate about a third axis separated from a first and second axes, and the attachment moving relative to the links, so that the first and second locking cams can be moved between their first and second positions by loads applied to the device through the attachment.

24 Claims, 9 Drawing Sheets

TWO-WAY LOCKING DEVICE FOR HEIGHT SAFETY APPARATUS

This invention relates to height safety equipment and in particular to a fall arrest device using a mobile anchorage to secure a user to an elongate support such as a cable lifeline. Such fall arrest devices are an important item of safety equipment for maintenance and construction personnel who work in high places, since they enable the risk of falls to be minimised.

In general, cable lifelines extend between end anchors or supports and are supported by intermediate brackets spaced along their length as required to maintain the cable lifeline in the desired path. Immediate brackets may also be located to support the cable lifeline in order to avoid excessive unsupported lengths of the lifeline and to prevent wind driven oscillation of the lifeline.

A number of fall arrest devices have been developed which are able to automatically traverse intermediate brackets supporting the elongate support element without any user intervention. One such device comprises a pair of rotatable wheels having a series of recesses at spaced locations around their peripheries, the adjacent recesses being separated by a radially projecting part of the wheel. These wheels are commonly referred to as star wheels. A cooperating slipper part is mounted on the wheels by engaging formations which interengage with complimentary formations on the radially projecting wheel parts. The space between the slipper part and the wheels is dimensioned to receive the elongate support element such as a cable lifeline so that the device is retained on the support element. When the device moves along the elongate support element and reaches an intermediate support the support passes between the slipper and the centres of the wheels and is received in one of the recesses of one of the wheels, rotation of the wheel then allows the device to move over the intermediate support without user intervention and without the retention of the device on the elongate support element being compromised.

Devices of this type are able to function satisfactorily on essentially horizontal cable lifelines. If the user attached to the device through the safety lanyard should fall, the fall can be arrested by the attachment of the safety lanyard to the cable lifeline through the device. The fall arrest load passing along the safety lanyard will be essentially perpendicular to the cable lifeline so that movement of the device along the cable lifeline will not be significant.

Where a device is to be used on a vertical or near vertical cable lifeline, it is necessary to provide some locking means so that the device can move along the cable lifeline to follow the user and will automatically grip or lock onto the cable lifeline when a fall occurs in order to stop the fall.

One such device here is described in European Patent No. EP 0272782 which discloses a self locking fall arrest device having a locking cam which is spring biassed to a locking condition in which it firmly grips the safety line to lock the device to the safety line. In use, the device is connected to a lanyard of a personnel safety harness so that the loading applied to the locking cam by the lanyard maintains the locking cam in an unlocking condition until such loading is released, for example when a fall occurs, whereupon the locking cam is automatically moved into its locking condition.

Devices of this type are suitable for use in vertical or near vertical installations but have only a uni-directional capability. That is, such devices must be installed on a safety line or cable in the correct orientation for safe operation. Accordingly, a device of this type cannot be used to ascend one side of a tall structure and descend the other side on a single safety line because the device will be incorrect ly oriented for the descent.

In practice, this limitation is not normally a problem because it is rare for there to be a requirement for a fall arrest device which has bi-directional capability in a vertical or near vertical orientation. This is because it is seldom the case that workers ascend one vertical or near vertical face of a structure and then descend a vertical or near vertical face of the same structure using a common safety line spanning the two faces.

However, the situation is different for safety lines inclined at intermediate angles between horizontal and vertical where it is often desirable for personnel to ascend a sloping surface and then descend another sloping surface on a common cable lifeline spanning both surfaces. This arrangement is commonly required where personnel are intended to work on pitched roofs.

In principle, it would be possible to use a uni-directional device and to require personnel to detach, reverse and reattach the device each time they cross the roof apex. In practice, many workers confronted this requirement will simply not bother to use the safety device, and even workers who do use the safety device will on occasion become confused and attach the device to the cable lifeline in the wrong orientation. Under these circumstances the lives of workers are placed unnecessarily at risk.

One known device able to operate an inclined cable lifeline in either orientation is the griplatch device produced by Latchways Plc.

The essential features of the griplatch device are shown in FIGS. 1 and 2.

The griplatch device comprises a star wheel type arrangement having a pair of star wheels 1 mounted on a common axle 2 and mounting between them a cooperating slipper 3. A pair of cam arms 4*a* and 4*b* are arranged between the wheels 1 and are pivotally supported by the axle 2. Each cam arm 4 defines a cam surface opposed to the slipper 3 and has an elongate arm section extending beyond the outer circumference of the star wheels 1 towards a remote end. The remote ends of the two cam arms are connected by two links 5*a* and 5*b*, each link 5*a* and 5*b* having a first end pivotally connected to a remote end of one of the cam arms 4*a* and 4*b* and a second end pivotally connected to the other link 5*a* or 5*b*.

In use the griplatch device is mounted on a cable safety line which passes through a receiving space defined between the two star wheels 1, the slipper 3 and the cam arms 4*a* and 4*b*. A safety lanyard 6 connected to a user safety harness is connected to a caribineer or similar connecting loop 7 which is passed around one of the links 5*a* and 5*b*. The connecting loop 7 is sufficiently large that it can pass from one link 5*a*, 5*b* to the other over their connecting point under the influence of the forces along the safety lanyard 6.

When the user ascends or descends with the griplatch device mounted on a inclined cable lifeline the forces along the lanyard 6 will pull the connecting loop 7 along the links 5 until the loop 7 is at or close to the pivotal connection between a link 5 and a cam arm 4 where they are connected at the up slope side of the device, as shown in solid lines in FIG. 1. The forces acting along the safety lanyard 6 substantially parallel to the cable will tend to act on the quadrilateral link formed by the two cam arms 4 and two links 5 to move the pivot point between the two links 5 towards the axis of rotation of the star wheels 1 and move the cam surfaces of the cam arms 4 away from the slipper 3. As a result, the griplatch device will be able to move freely along the cable following the user's movements.

If a fall event occurs, the safety lanyard 6 and connecting link 7 will move downwards and away from the cable lifeline on to the down slope one of the links 5, for example the position as shown in dashed lines in FIG. 1. The fall load applied along the safety lanyard 6 will have a large component acting perpendicularly away from the cable lifeline and this will tend to pull the pivotal connection between the two links 5 away from the axis 2 of the star wheels 1. This will cause the cam arms 4 to rotate about the axle 2 bringing the cam surfaces of the cam arms 4 towards the slipper 3 to grip the cable lifeline between the cam surfaces of the cam arms 4 and the slipper 3. In practice, the vertical load along the safety lanyard 6 will also produce a couple causing the entire linkage formed by the cam arms 4 and link lanyard to rotate about the axle 2 in a sense so that the down slope one of the cam surfaces will be the only one which will grip the cable safety line against the slipper 3.

The symmetrical arrangement of the griplatch device enables it to operate as a bi-directional device unaffected by the directional of the slope of the cable.

The main limitation of the griplatch device is that it can only operate on cable life lines up to a maximum angle from the horizontal. If the angle of the safety line is too great, the down slope links will be close enough to the horizontal that when a fall arrest event occurs the loop 7 could slide along the down slope link away from the pivotal connection between the two links and towards to the pivotal connection between the down slope link and its associated cam arm. Movement of the loop 7 into this position will cause the quadrilateral linkage to move back towards the position shown in FIG. 1, releasing the grip of the device on the cable lifeline.

This problem is made worse by the fact that in practice the geometry of many falls will be such that after the fall is arrested the user hanging from the safety lanyard 6 will be swinging beneath the device. Such swinging movement can cause sliding of the loop 7 along the link 5 to a position where the device will release the grip on the cable lifeline when the inclination of the cable lifeline would not otherwise be sufficient to cause such release.

This problem is also made worse by the fact that when a fall arrest event occurs it is usual for the cable lifeline to extend due to stretching and/or the deployment of in line energy absorbers so that the cable lifeline sags down between the intermediate supports on either side of the device. This sagging can cause the cable inclination at the device location to be higher than the cable inclination before the fall arrest event occurred.

The present invention was made in an attempt to overcome these problems and disadvantages of the prior art.

This invention provides a fall arrest device for use on an elongate support, said device comprising: chassis means having safety support retaining means to retain an elongate support whilst allowing movement of the device therealong, and including a sliding element for slidably engaging said elongate support; first and second locking cam means for locking the device to the elongate support in a fall arrest situation; first and second link means; and attaching means for attaching personnel safety means to the device and transmitting a load form the personal safety device to said link means; in which said first and second locking cam means comprise respective first and second cam elements each arranged for rotation about a respective first axis relative to the chassis and able to move between a first locking position in which the cam element traps the elongate support between itself and the sliding element and a second released position in which the cam element does not trap the elongate support; the first and second link means each being connected to a respective one of the first and second cam elements for mutual rotation about a respective second axis separated from said first axis, the first and second link means being connected together for mutual rotation about a third axis separated from said first and second axes, and the attaching means being able to move relative to the link means, so that the first and second locking cam means can be moved between their first and second positions by loads applied to the device through the attaching means;

in which each of the first and second link means comprises two parts arranged for reversible relative movement in response to an applied load from the attaching means above a predetermined value, the movement being such that a part of the link means intermediate said second and third axes descends relative to said second axis.

Preferred embodiments of the invention will now be described by way of example only with reference to the accompanying diagrammatic Figures, in which.

Figure 1:
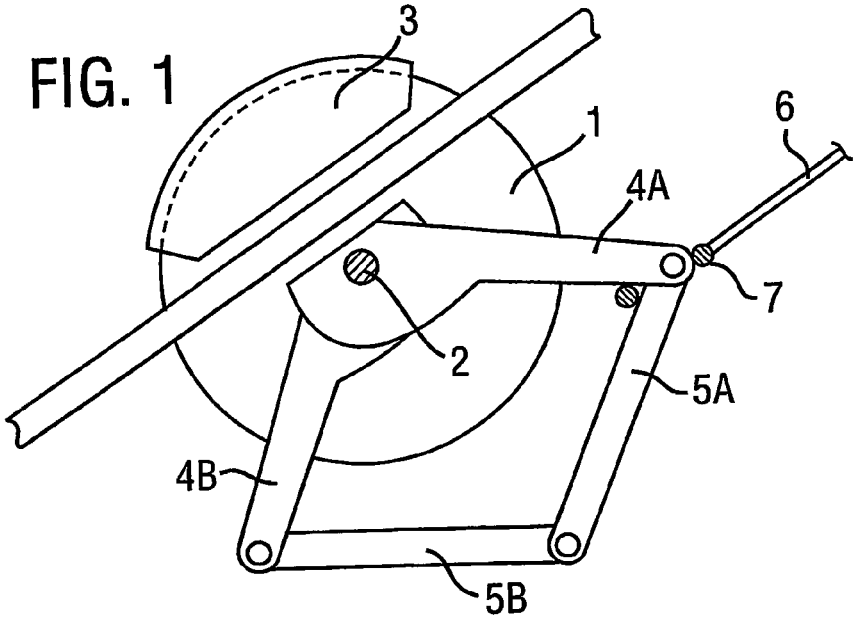
FIG. 1 shows a prior art locking device in the unlocked condition.
Figure 2:
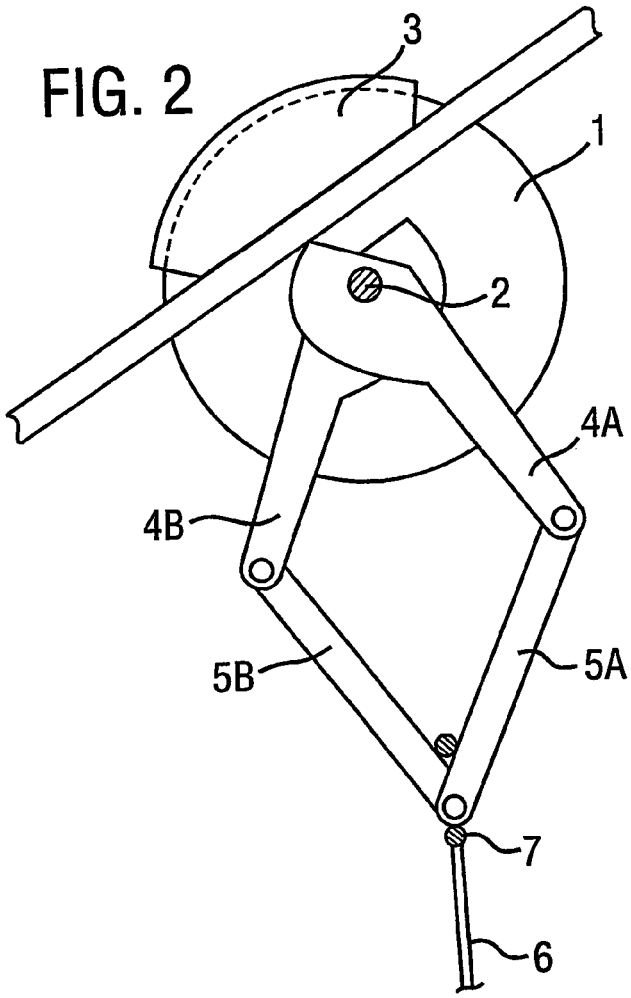
FIG. 2 shows the device of FIG. 1 in a locked position.
Figure 3:
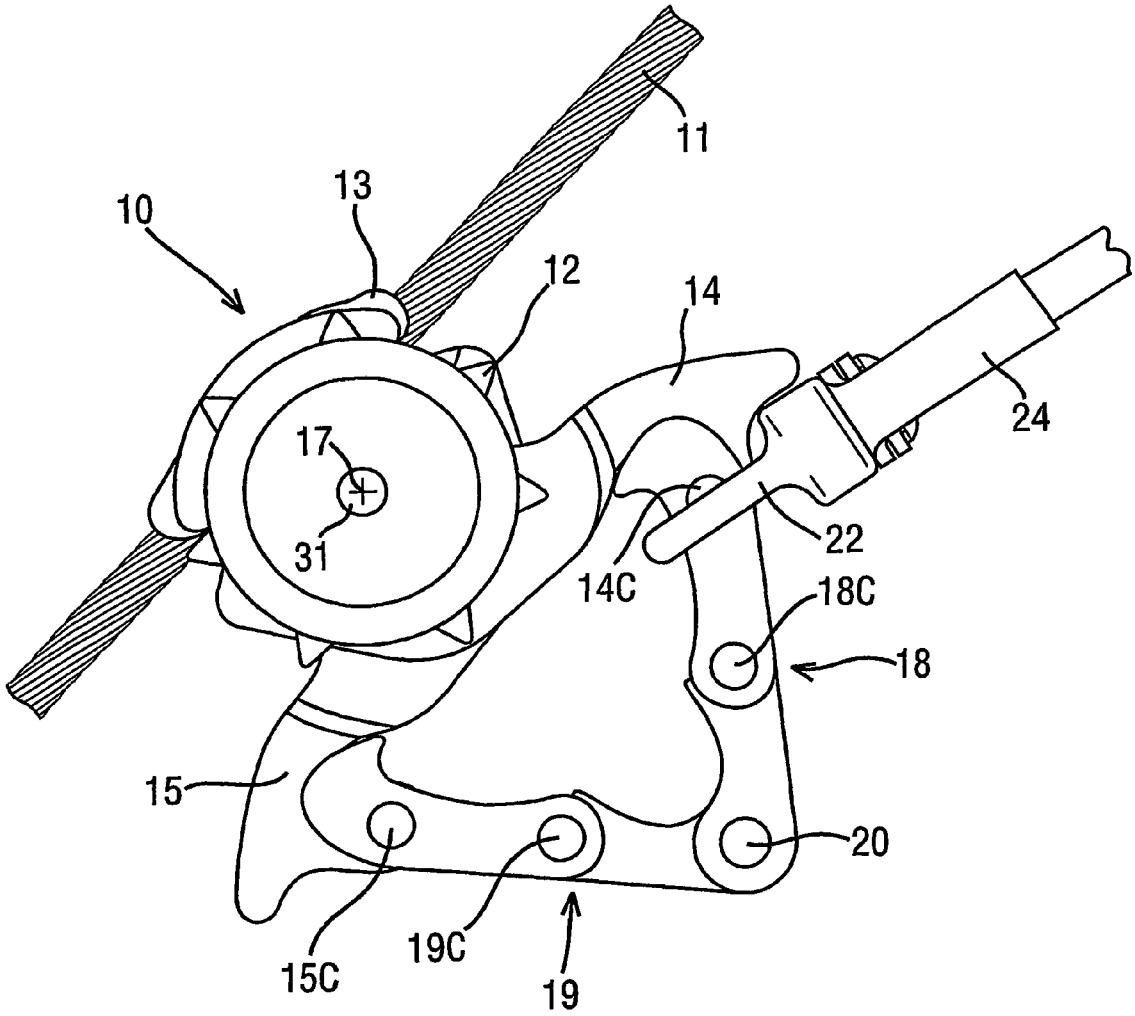
FIG. 3 shows a side view of a first embodiment of a locking device according to the invention in an unlocked condition.
Figure 6A:
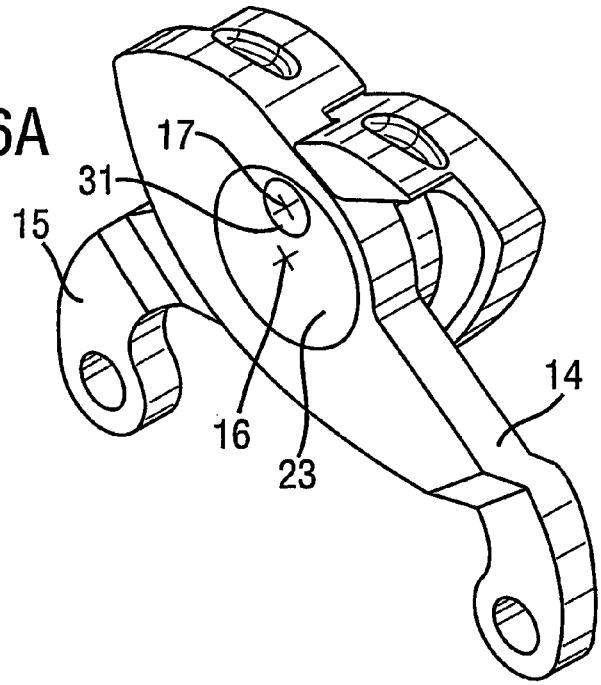
Figure 6B:
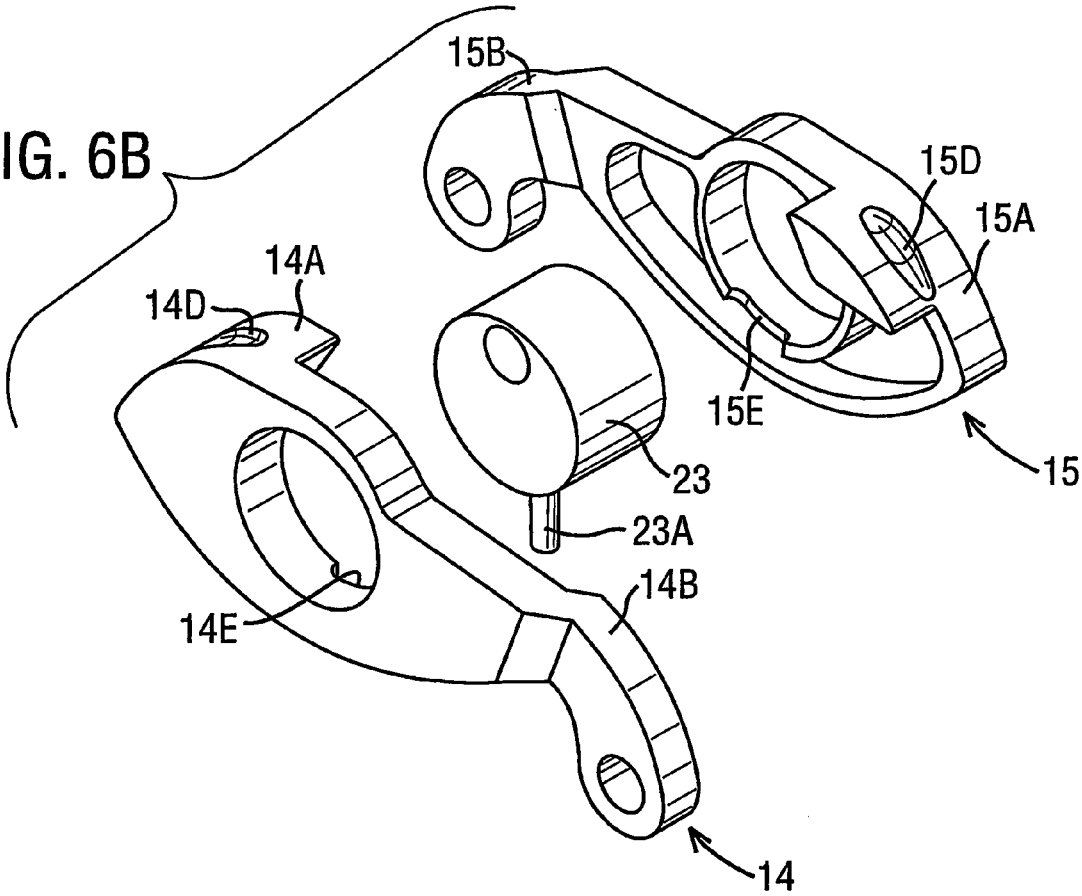
Figure 7:
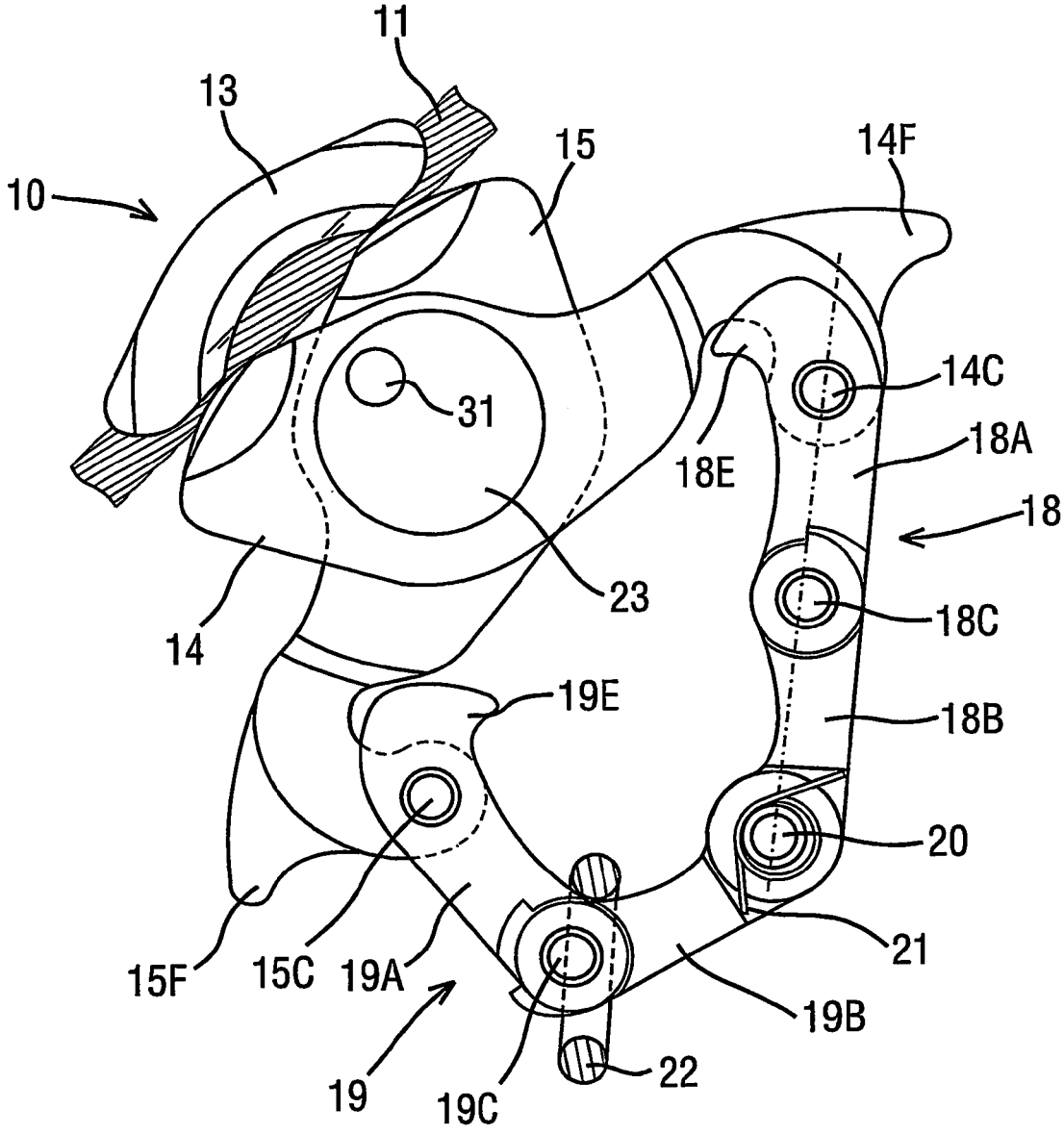
Figure 8:
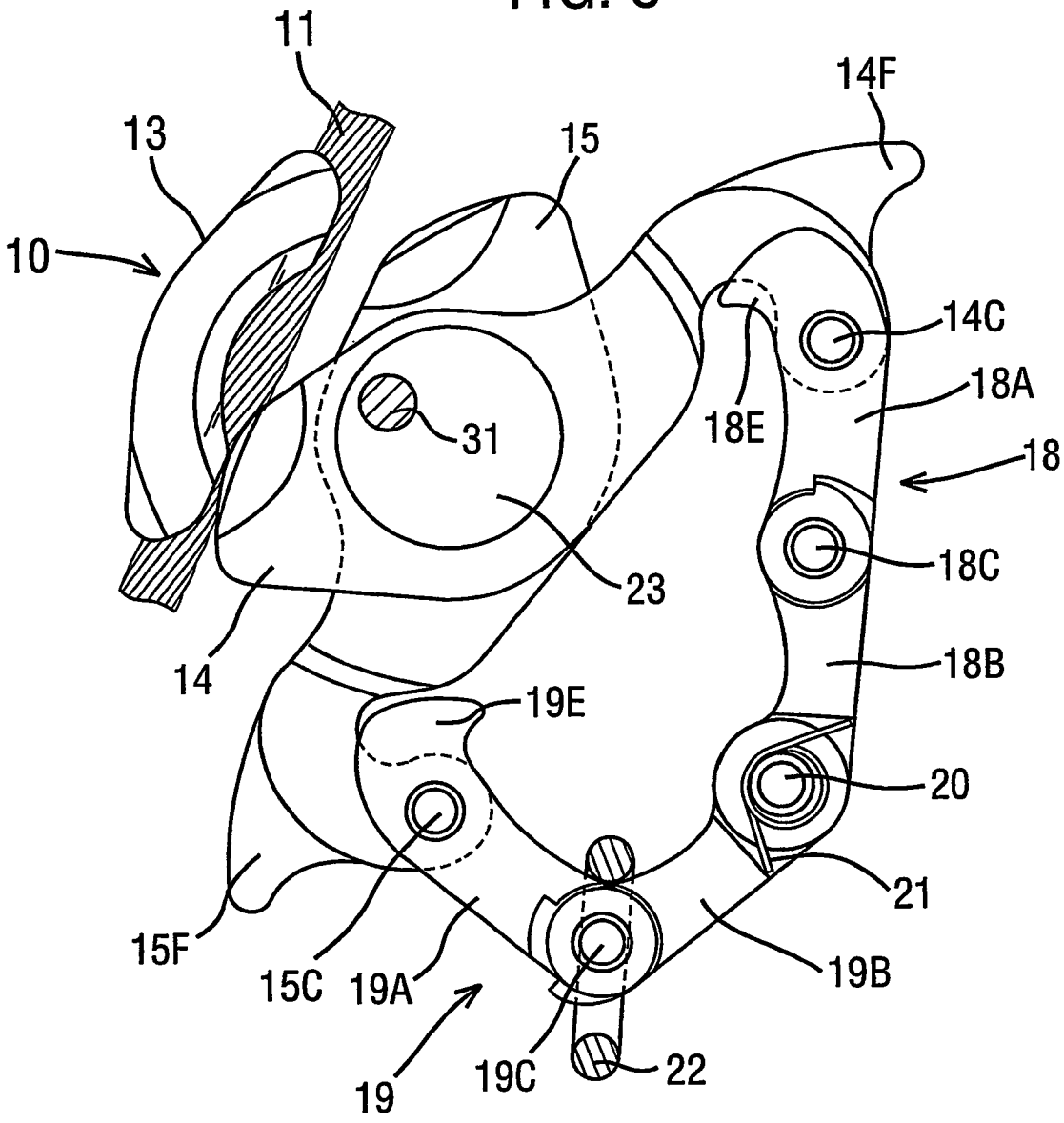

FIG. 6*a* a perspective view of the cam arms and boss of the device of FIG. 3;

FIG. 6*b* shows an exploded view of the parts of FIG. 6*a*,

FIG. 7 shows a partially cut-away side view of the device of FIG. 3 when subjected to a vertical load above the buckling threshold of the two part links;

FIG. 8 shows a cut away side view of the device of FIG. 7 mounted on a more steeply inclined cable;

FIGS. 9*a* to 9*d* shows a side view of a device according to a second embodiment of the invention.

Figure 4:
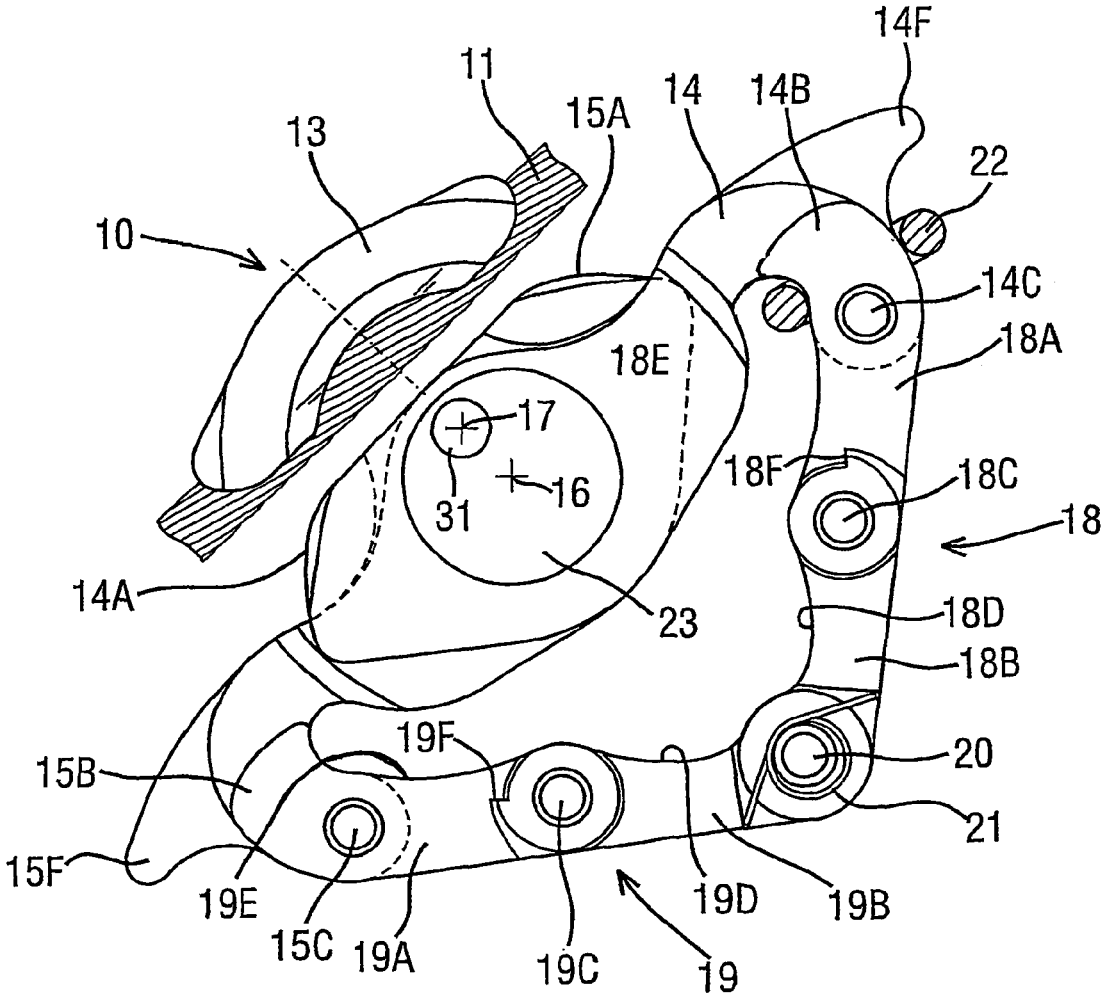
FIG. 4 shows a partially cut-away view of the device of FIG. 3.

A first embodiment of a two way locking device 10 according to the invention suitable for use in height safety apparatus is shown in side view in FIG. 3. The same two way locking device 10 is shown in FIG. 4 in a partial cut away view in order to allow the locking mechanism to be clearly seen.

The device 10 is shown mounted on an inclined safety line cable 11 in the Figures.

The device 10 comprises a pair of spaced apart star wheels 12 mounted for rotation about a common axis 17 on an axle 31 and supporting between them a slipper 13 mounted on star wheels 12 by means of formations which inter-engage with cooperating formations on the radially projecting points of the star wheels 12.

As explained in the introductory section of this application, star wheel type devices have been in use for many years so that their general function and operation will not be described in detail herein.

A pair of cam arms 14 and 15 are mounted between the star wheels 12 so that a receiving space is defined between the star wheels 12, slipper 13 and cam arms 14 and 15. The cable 11 passes through the receiving space so that the two way locking device 10 is retained on the cable 11. The cam arms 14 and 15 are mounted for mutual pivotal movement about an axis 16 parallel to but offset from the axis of rotation 17 of the star wheels 12. The axis 16 is located so that the axis 17 lies between the receiving space and the axis 16. Each of the cam arms 14 and 15 have a respective engaging portion 14*a*, 15*a* which can be brought into engagement with the cable 11 by rotation of the respective cam arm 14, 15 about the axis 16 so that the cable 11 can be gripped between either or both of the engaging portions 14*a* and 15*a* and the slipper element 13 to lock the device 10 to the cable 11. In FIG. 4, part of the cam arm 14 lies in front of the cam arm 15. Each cam arm 14 and 15 has an arm portion extending away from the pivot axis 16 and ending in a respective end section 14*b*, 15*b*. Each of the cam arms 14, 15 is connected at it's respective end section 14*b*, 15*b* to a first end of a respective two part link 18 and 19 for mutual pivotal movement about a respective axis 14*c*, 15*c*. The two two part links 18 and 19 are connected together at their respective second ends remote from the first ends for mutual pivotal movement about an axis 20.

Each two part link 18 or 19 is made of two arms 18*a*, 18*b* and 19*a*, 19*b*. Each of the arms 18*a*, 18*b* and 19*a*, 19*b* is substantially straight having first and second ends. The two arm sections 18*a*, 18*b*, and 19*a*, 19*b* respectively making up each two part link 18 and 19 are pivotally connected together for mutual rotation about an axis 18*c*, 19*c*.

The cam arms 14, 15 and two part links 18,19 form a quadrilateral, or four arm, linkage.

The pivotal connection between the first and second arms 18*a*, 18*b*, 19*a*, 19*c* of each two part linkage 18,19 allows rotation about a respective axis 18*c*, 19*c* limited by a stop 18*f*, 19*f*, formed by opposed engaging surfaces arranged radially to the respective axis 18*c*, 19*c* on the arms 18*a*, 18*b*, 19*a*, 19*b*. The effect of the stops 18*f*, 19*f* is to limit relative pivotal movement of the arms 18*a*, 18*b*, 19*a*, 19*b* of each two part link 18, 19 in a direction moving the respective axis 18*c*, 19*c* inwardly towards the pivotal axis 16 of the cam arms 14 and 15. In the illustrated embodiments this stopping occurs when the pivoting axes 14*c*, 18*c* and 20 and 15*c* and 19*c* and 20 respectively of each two part link 18, 19 are arranged in a straight line. This straight line arrangement of the axes at the stopping position is convenient, but is not essential.

A torsion spring 21 passes around the axle of the pivot axis 20 and is arranged to bias the two part arms 18 and 19 about the pivoting axis 20. The biassing acts in a sense which will rotate the cam arms 14 and 15 about their axis of mutual rotation 16 into gripping engagement with the cable 11. This biassing also urges the axes 18*c*, 19*c* between the respective two arms 18*a*, 18*b*, 19*a*, 19*b* of each of the two part links 18 and 19 inwardly towards and against their respective stop mechanisms 18*f*, 19*f*.

Figure 5:
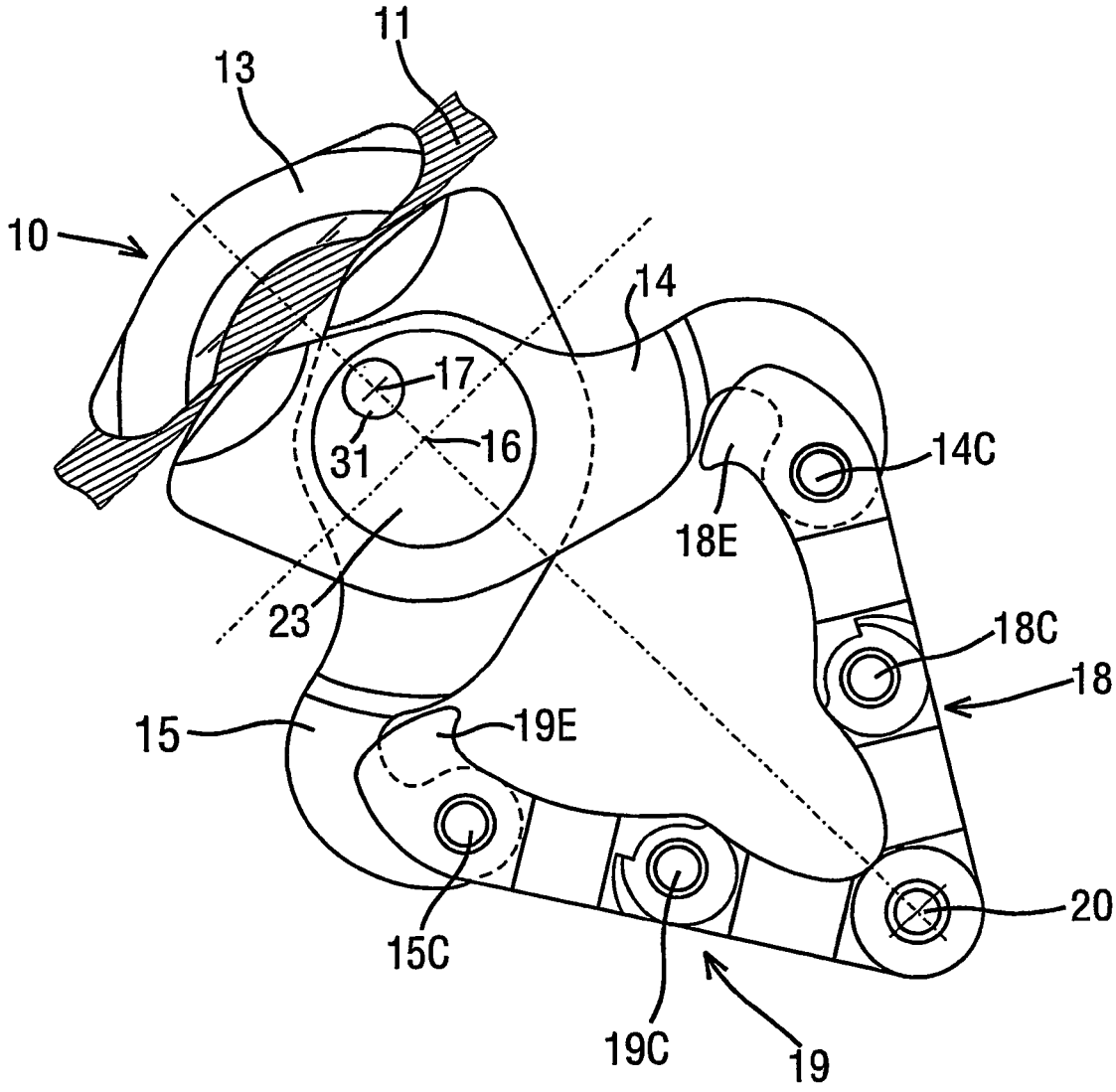
FIG. 5 shows a partially cut-away view of the device of FIG. 3 in a locked condition.

As a result, when no external loading is applied to the device 10, the device 10 automatically moves as a result of the action of the biassing spring 21 into the position shown in FIG. 5 where the cable 11 is gripped between the slipper 13 and the engaging portions 14*a*, 11*a* of both of the cam arms 14 and 15 so that the device 10 is locked in place on the cable 11.

In use, the user wears a fall safety harness attached by a safety lanyard to a connecting loop 22. The connecting loop 22 is sized to slip freely under an applied load over the two part links 18 and 19. When the applied load is applied to the device 10 along the safety lanyard substantially parallel to the cable 11, as shown in FIGS. 3 and 4, the applied load counteracts the biassing by the spring 21 and moves the cam arms 14 and 15 into an open position where their engaging portions 14*a* and 15*a* do not grip the cable 11. As a result, the device 10 can move freely along the cable 11.

This is the situation which will apply when the user is moving up or down alongside the inclined cable 11. When the user is ascending, the device 10 will be dragged up the cable 11 by the safety lanyard. When the user is descending, the device 10 will be lowered down the cable 11 hanging from the safety lanyard. In order for the device 10 to be able to automatically descend along an inclined cable 11, the biassing force of the spring 21 must be selected such that the device will remain in the non-gripping state when its weight is supported from the safety lanyard.

The first arm 18*a*, 19*a* of each two part link 18 and 19 includes an extension portion 18*e*, 19*e* extending to the opposite side of the respective axis 14*c*, 15*c* as the remainder of the two part link 18, 19. These extension sections 18*e*, 19*e* are arranged and shaped so that when the device 10 is in the gripping or locked position as shown in FIG. 5, the extension sections 18*e*, 19*e* project further into the interior of the four arm linkage formed by the cam arm 14, 15 and two part links 18, 19 than the respective end sections 14*b*, 15*b* of the cam arms 14, 15, but are substantially coplanar with the inner surfaces of the respective end sections 14*b*, 15*b* when the device 10 is in the unlocked position as shown in FIG. 4.

As a result, when the connecting loop 22 moves over the two part links 18 and 19 in response to a load applied substantially parallel to the cable 11, the connecting loop 22 will bear on the inner surface of one of the extending sections 18*e*, 19*e* at a position between the respective axis 14*c*, 15*c* and the cable 11. As a result, the load applied through the end loop 22 will have a considerable mechanical advantage due to leverage assisting it in overcoming and reversing the biassing of the device 10 into the closed or gripping position due to the spring 21 and the weight of the device 10.

Each cam arm 14 and 15 has a respective outwardly projecting shoulder portion 14*f*, 15*f*. The shoulder portions 14*f* and 15*f* are sized so that the connecting loop 22 cannot pass along the cam alms 14 and 15 past the respective shoulders 14*f*, 15*f*. This arrangement is preferred in order to prevent connecting loop 22 passing too far along the cam arms 14 and 15. In the preferred embodiment of the device 10, even if the safety lanyard becomes looped over the cable 11 or around the device 10, for example by passing over the top of the slipper 13, when a fall arrest load is applied the device 10 will rotate around the cable 11 into an alignment allowing good and reliable gripping of the cable 11. Such automatic rotation might be prevented or rendered unreliable if the connecting loop 22 was able to pass too far along the cam arms 14 and 15. This possibility is prevented by the shoulders 14*f* and 15*f* which limit the movement of a detached loop 22 along the cam arms 14 and 15. Other arrangements for controlling movement of the connecting loop 22 along the cam arms 14 and 15 would be possible, or for some designs of device may not be required. However, use of the shoulders 14*f*, 14*f* is preferred.

In practice, it is possible that the device 10 could be damaged by torsional loads transmitted along the safety lanyard to the device 10. In order to eliminate this possibility, it is preferred for the detached loop 22 to be linked to the safety lanyard by an arrangement allowing torsional loads to be eliminated without transmission to the device 10. A preferred arrangement is shown in FIG. 3 where the connecting loop 22 is linked to the safety lanyard through a twistable connector 24 able to freely rotate relative to the connection loop 22 about an axis linking the connection loop 22 to the safety lanyard loads, an axis lying in the plane of the paper in FIG. 3.

As explained above, the axis 16 of the mutual pivotal movement of the cam arms 14 and 15 is offset from the axis of rotation 17 of the star wheels 12. The mechanism to do this is shown in more detail in the perspective view 6*a* showing the cam arms 14, 15 in detail and the corresponding exploded perspective view 6*b*.

The cam arms 14 and 15 are arranged to be able to rotate about a cylindrical boss 23. The cylindrical boss 23 is itself arranged for rotation about the start wheel axis 17, such that the axis 17 is offset from the axis 16 at the centre of the boss 23, about which the cam arms 14 and 15 rotate.

As can be seen in FIG. 6, the overlapping parts of the cam arms 14 and 15 are arranged between the star wheels, each having a thickness of about half of the separation between the star wheels 12 while the respective engagement portions 14*a* and 15*a* of the cam arms 14 and 15 extend across the full separation between the two star wheels 12 in order to ensure good gripping of the cable 11. Bach of the engagement portions 14*a* and 15*a* has a recessed part 14*d*, 15*d* having a substantially cylindrical concave face matching the external surface profile of the cable 11. Inclusion of the recesses 14*d*, 15*d* is preferred to improve the grip on the cable 11, but this is not essential.

It should be understood that if no restraint is placed on the relative pivotal movement of the cam alms 14 and 15 about the boss 23 and of the boss 23 about the axis 17, it would be possible for the cam arms 14 and 15 and boss 23 to move into positions which could cause problems. For example, when the device 10 was not mounted upon the cable 11, it might be possible for the cam arms 14 and 15 and boss 23 to be moved into a position in which a cable 11 could not be passed through the device 10 in order to install the device 10 on the cable 11 and the cam arms 14 and 15 could not easily be moved to a position allowing cable 11 to pass through the device 10, causing frustration and inconvenience.

The boss 23 has a radially extending pin 23*a* located midway along the boss 23 so that the pin 23*a* extends between the cam arms 14 and 15. Each of the cam arms 14 and 15 has a respective control slot 14*e* and 15*e* arranged so that the pin 23*a* is received within the control slots 14*e*, 15*e*. In this arrangement, relative movement of each of the cam arms 14*a*, 15*a* relative to the boss 23 is controlled by the length of the respective control slot 14*e* and 15*e*. When the pin 23*a* contacts the end of the control slot 14*e*, 15*e*, movement of the respective cam arm 14, 15 is stopped. Thus, the pin 23*a* and the control slots 14*e*, 15*e* set the available range of pivotal movement of the cam arms 14 and 15 relative to one another and to the boss 23. Although this does not directly limit rotation of the boss 23 about the axis 17, it will be understood that available range of movement of the cam arms 14 and 15 about the axis 17 is limited by contact of the cam arms 14 and 15 with the cable 11 or slipper 13 so that the pin 23*a* and control slots 14*e*, 15*e* also limit the possible range of rotation of the boss 23 about the axis 17.

The described structure of the cam arms 14 and 15 in which the respective engagement portions 14*a* and 15*a* extend across the full separation between the two star wheels 12 will automatically limit the amount of possible relative pivotal movement of the cam arms 14 and 15 about the boss 23 by contact of the engagement portions 14*a* and 15*a* with one another and the other parts of the cam arms 14 and 15.

However, it is preferred to have the pin 23*a* and control slots 14*e*, 15*e* limit the relative movement of the cam arms 14 and 15 as well as their movement about the boss 23 so that it is not necessary to select the shape and materials of the cam alms 14 and 15 to support the loads which will occur at the points of contact between the cam arms 14 and 15 at the limits of their movement. However, it would be possible to have the pin 23*a* stop only the rotation of the cam arms 14 and 15 about the boss 23 while the relative movement of the cam arms 14 and 15 was limited by some other stopping mechanism such as contact between parts of the cam arms 14 and 15.

When a fall occurs, the load applied through the safety lanyard will drop to substantially nothing, the safety lanyard will go slack and the connecting loop 22 will tend to drop towards the connection point between the two two-part links 18 and 19 and will come to rest on the downslope two part link, the two part link 19 in the Figures.

The release of the load applied through the connecting loop 22 will allow the device to move back towards the gripping position as shown in FIG. 5 under the influence of the bias from spring 21. When a fall occurs, the connecting loop 22, after moving over the two part links 18 and 19, will apply a vertically downward load passed along the safety lanyard to the down slope two part link, the two part link 19 in the Figures. Usually, this vertically downward load will be applied to the arm of the downslope two part link closest to the axis 20, the arm 19*b* of the two part link 19 as shown in the Figures. The component of the fall arrest load acting away from the cable 11 tends to move the axis 20 between the two two part links 18 and 19 away from the mutual pivoting axis 16 of the cam arms 14 and 15 and this component of the load, together with the biassing force from the spring 21, urges the device 10 towards the gripping position shown in FIG. 5 in which the cam arms 14 and 15 grip the cable lifeline 11 against the slipper 13.

Further, this vertical load applied through the connecting loop 22 generates a couple on the entire linkage formed by the cam arms 14 and 15 and two part links 18 and 19 which tends to rotate the linkage around the axis of rotation 16 of the cam arms 14 and 15 about the boss 23. This couple tends to rotate the downslope engagement portion 14*a* of the cam arm 14 towards the cable 11 and the slipper 13.

Finally, the vertical fall arrest load applied through the connecting loop 22 also produces a couple about the axle 17 of the star wheels 12. Because the centre of the boss 23 is offset from the axle 17, this produces a rotation of the boss 23 and the entire linkage supported on the boss 23 about the axle 17 in a sense, again, tending to bring the downslope gripping portion 14*a* towards the cable 11 and the slipper 13.

When a fall arrest event occurs, the combination of these three movements produced by the vertical load transmitted through the safety lanyard and connecting loop 22 causes the cam arms 14 and 15 to move so that the downslope engaging portion 14*a* of the cam arm 14 moves quickly and positively to grip the cable lifeline 11 against the slipper 13.

As a result, the use of an arrangement in which the axis 16 of the pivotal movement of the cam arms 14 and 15 is offset from the axis of rotation of the star wheels 12 allows an improved gripping action.

The rotation of the cam arms 14 and 15 and attached parts about two parallel spaced apart axes 16 and 17 allows the geometry of the cam arms 14 and 15 relative to the cable 11 to change in response to the applied load. When the device 10 is being locked to the cable 11 by a vertical fall arrest load, or other applied vertical, or non-horizontal load, that is, the device 10 is moving from the unlocked position to a locked position, the applied load will tend to move the cam arms 14 and 15 about the axis 16 and also the boss 23 about the axis 17 in the same sense, clockwise in FIG. 4. These combined movements will change the geometry of the cam arms 14 and 15 relative to the cable 11 so that the point of contact of the downslope engagement portion, the engagement portion 14*a* of the cam arm 14 in the figures, will move up slope along the cable 11 closer to the centre of the slipper 13 compared to the position at which it would contact the cable 11 if no rotation of the boss 23 about the axis 17 took place.

Once the downslope engagement portion is in contact with the cable 11, the applied load will cause further relative rotation of the cam arms 14 and 15 until the upstream engagement portion is also in contact with the cable 11 and the device 10 is in the locked position, as shown in FIG. 5. While this further movement is taking place, the rotation of the boss 23 about the axis 17 will be reversed, returning the device 10 to a symmetrical position where the axes 16, 17 and 20 are all coplanar along the centreline of the device 10. This is also the position into which the device 10 is urged by the torsion spring 21.

As a result of this change in geometry, when the device 10 is closed or locked by a large vertical load such as a fall arrest load, the geometry of the cam arm 14 having the downslope gripping portion 14*a* is made more like a self closing cam or cleat geometry. This results in an improved gripping action and makes the device more resistant to incorrect releasing of the grip of the cable 11 due to bouncing or rebounding of the user following a fall arrest event. Such bouncing or rebounding can result in the load applied along the safety lanyard dropping momentarily or for short periods to a low level or in extreme cases to zero. In previously known devices, such temporary reductions in the applied vertical load can result in the device temporarily unlocking itself from the cable and then re-locking again when the load is re-applied. Such locking and re-locking is uncomfortable and alarming for the user and can be dangerous.

The change in geometry of the device 10 under the load allowed by the use of two offset axes of rotation 16, 17 to move the contact point of the downslope engagement portion nearer to the centre of the device 10 improves the initial grip on the cable 11 by the device 10. This both ensures quicker and more definite working and locking of the device 10 to the cable 11 under an applied fall arrest load when a fall arrest event occurs and also increases the grip of the device 10 due to its own weight and the bias of the spring 21 if the load applied to the device along the safety lanyard is temporarily reduced or removed during the locking process so that the device 10 is more resistant to unwanted unlocking and re-blocking when the user bounces, rebounds or oscillates during a fall arrest event.

In addition to the actions described above, the vertically downward fall arrest load applied to the two part link 19 through the connecting loop 22 will cause the two part link to buckle or yield, moving the pivotal axis 19*c* between the two arms 19*a* and 19*b* of the two part link 19 downward against the bias applied by the spring 21. Downward movement of the pivotal axis 19*c* will require rotation of the arms 19*a* and 19*b* of the two part link 19 away from their stopped position. This change in the geometry of the two part link 19 will move the pivotal axes 15*c* and 20 connecting the two part link 19 to the cam arm 15 and the two part link 18 respectively towards one another, towards and then into the position shown in FIG. 7.

This buckling or yielding of the two part link 19 will occur mostly after the downstream engaging portion 14*a* of the cam arm 14 has been brought in contact with the cable 11 and begun gripping it against the slipper 13. Until this contact is made, the linkage will tend to respond to the applied load by rotation of the cam arms 14 and 15 and the boss 23 about the axes 16 and 17. However, under the suddenly applied fall arrest loading some buckling of the two part link 19 may occur before this contact is made.

The buckling of the two part link 19 while the device is moving from the unlocked position to the locked position will tend to close the cam arms so that the upstream gripping portion is brought towards the cable 11.

As can be seen in FIG. 7, the yielding of the two part link 19 results in the connecting loop 22 being suspended from the two part link 19 close to or at the pivoting axis 19*c* and below the axes 15*c* and 20. As a result, sliding of the connecting loop 22 along the two part link 19 towards the cam arm 14 is suppressed or prevented by the upward slope formed by the interior face of the arm 19*a* between the axes 15*c* and 19*c*. As a result, the device 10 according to the present invention can safely and reliably operate on a cable 11 inclined at larger angles to the horizontal than previously known devices.

The lowering of the centre of the two part link 19 relative to its ends due to yielding will inhibit or prevent movement of the connecting loop 22 into a position where it will tend to release the grip of the device 10 on the cable 11 both due to the static geometry of the device mounted on a cable lifeline inclined at a large angle to the horizontal and also due to the dynamic loads encountered when a user is swinging below the device 10 after a fall arrest event has occurred.

It should be understood that the symmetrical arrangement of the device 10 allows it to operate with equal effectiveness on a cable inclined in either direction, without any user action being required when the sense of the inclination is reversed.

As can be understood from the above, the buckling of the two part link 19 tends to close up the cam arms 14 and 15 bringing the respective pivot axes 14*c* and 15*c*, connecting the cam arms 14 and 15 to the two part links 18 and 19 towards one another. As explained above, the downslope engagement portion 14*a* of the cam arm 14 is brought first into gripping contact with the cable 11 by the applied fall arrest load and as a result the relative movement of the cam arms 14 and 15 due to the buckling or yielding of the two part link 19 before the upstream engagement portion 15*a* is brought into grippiong contact is accommodated by moving the other parts of the linkage around the contact point between the engagement portion 14*a* and the cable 11. This movement tends to centralise the rotation of the boss 23 about the star wheel axis 17 and the rotation of the linkage comprising the cam arms 14,15 and the two part links 18, 19 about the axis 16 of the boss 23. Thus the buckling of the link and the closing of the cam arms 14 and 15 both tend to bring the engagement portion 15*a* of the cam arm 15 towards the cable 11.

When the device 10 is attached to a cable 11 having a relatively low angle of inclination to the horizontal both of the engagement portions 14*a* and 15*a* of both of the cam arms 14 and 15 will be brought into gripping engagement with the cable 11 and the rotation of the boss 23 will be substantially reversed to a central, symmetrical, position. An example of this is shown in FIG. 7 where the device 10 is shown mounted on a cable 11 inclined at 47 degrees to the horizontal.

When the device 10 is attached to a cable 11 having a larger angle of inclination to the horizontal the engagement portion 15*a* of the cam arm 15 will still move towards the cable 11, but not sufficiently far to make contact with the cable 11 so that only the downslope engagement portion 14*a* of the cam arm 14 will be gripping the cable 11 against the slipper 13. An example of this is shown in FIG. 8 where the device 10 is shown mounted on a cable 11 inclined at 75 degrees to the horizontal.

In order to unlock the device 10 from the cable 11 it is necessary to apply a load along the safety lanyard to move the connecting loop 22 along the two part links 18 and 19 towards the axis 14*c* between the two part link 18 and the cam arm 14.

As can be seen in the figures, the arms 18*b*, 19*b* of the two part links 18, 19 connected at the axis 20 have inner surfaces 18*d*, 19*d* which are curved to present a concave profile. When no load is applied along the safety lanyard the connecting loop 22 will fall under its own weight, and the weight of the safety lanyard, into the bottom corner of the linkage, that is adjacent the axis 20 at the pivotal connection between the two two part links 18 and 19. Further, if the safety lanyard is moved in orientation with a load continuously applied between a substantially vertical load direction locking the device 10 into engagement with the cable 11 towards a load direction substantially parallel to the cable, the applied load must move through a position urging the connecting loop 22 into this bottom corner of the linkage.

As a result of the concave profile of the inner surfaces 18*d*, 19*d* of the arms 18*b*, 19*b*, if the connecting loop 22 is pulled from the bottom corner location adjacent the axis 20 by a continuous force along the safety lanyard acting substantially parallel to the cable, the connecting loop will become trapped in the concave surface 18*d* of arm 18*b* and will not be able to pass off the arm 18*b* over the joint between the arms 18*a* and 18*b* to reach a position where it can unlock the grip of the device 10 on the cable 11. In order to pass the connecting loop 22 off the concave surface 18*d* and off the arm 18 it is necessary for the user to jerk or crack the safety lanyard.

The use of concave inner surfaces on arms 18*b* and 19*b* is preferred because this requirement for a positive user action to unlock the device 10 from a gripping state can be a useful safety feature, but this is not essential.

The inner surfaces 18*e* and 19*e* of the arms 18*a* and 19*a* of the two part links 18 and 19 also have a concave profile. When the two part link 18 or 19 is buckled by an applied fall arrest load, for example as shown in FIGS. 7 and 8, this concave profile increases the steepness of slope of the inner surface 18*e*, 19*e* presented to the connecting loop 22. This increase in steepness makes it less likely that the connecting loop 22 will be able to move along the arm 18*a*, 19*a* (19*a* in the figures) to a position adjacent the axis 15*c* and incorrectly unlock the grip of the device 10 on the cable 11. The use of concave inner surfaces on arms 18*a* and 19*a* is preferred to give an increased margin of safety, but this is not essential.

As the linkage moves from the engaged or gripping position shown in FIG. 5 to the free or released position shown in FIG. 4, the engagement portions 14*a* and 15*a* of the cam arms 14 and 15 are withdrawn from gripping contact with the cable 11, by mutual rotation of the cam arms 14 and 15 about the axis 16 of the boss 23. The axis 16 is displaced from the axis of rotation 17 of the star wheels 12 and this results in a smoother and improved release of the grip on the cable 11. This smoother release of the grip is partially due to the lateral component of movement of the engagement portions 14*a* and 15*a*, that is the component of movement parallel to the cable 11, produced by the offset axes of rotation 16 and 17 of the cam arms 14 and 15 and the star wheels 12. The movement of the contact point of the downslope engagement portion allowed by the use of two parallel spaced apart axis of rotation 16 and 17 results in the geometry and movement of the cam arms 14, 15 relative to the cable 11 being different during gripping of the cable 11 by the device 10 in response to an applied vertical load and release of this grip under an applied load substantially parallel to the cable 11. This difference in the geometry of the gripping and ungripping actions allows both actions to be improved. Further, the offset between the axes 16 and 17 increases the amount of movement of the engagement portions 14*a*, 15*a* of the cam arms 14,15 away from the cable 11 for a given angular movement of the cam arms 14, 15. This also improves the release of the grip. Further, this increased travel of the engagement portions 14*a*, 15*a* increase the clearance between the cable 11 and the cam arms 14,15 in the unlocked position, making it simpler for the device 10 to traverse intermediate supports. These improvements could otherwise only be achieved by undesirable increases in the size or extent of allowed pivotal movement of the device 10.

The smooth release of the grip is further improved by the recesses 14*d*, 15*d* in the engagement portions 14*a* and 15*a* which reduce the point loads between the engagement portions 14*a*, 15*a* and the cable 11. However, the use of such recesses is not essential.

As explained above, the device 10 according to the invention is intended to be operated by a safety lanyard attached to a personal user safety harness, so that the device 10 can be automatically locked to or released from a safety line cable 11 by the load applied along the safety lanyard. In practice, there may be some height safety system arrangements in which the device 10 cannot properly function. For example, if the cable 11 is above the user's work or travel area so that the cable 11 is overhead the user, it may be difficult or impossible for the user to apply a load to the device 10 along the safety lanyard at an angle which will unlock the device 10 from the cable 11. It is advantageous to be able to use the device 10 in such a height safety system geometry in order to allow the device 10 to be used in as wide as possible arrange of height safety systems. This allows the device 10 to be used throughout a height safety system in which some parts have such a geometry and other parts do not. Further, extending the range of possible height safety systems in which device 10 can be used may avoid the requirement to employ multiple types of fall arrest device, so making it easier to maintain the devices and provide the necessary range of spares.

A device 30 according to the second embodiment of the invention is shown in FIG. 9. The device 30 is similar to the device 10 but has an additional control member 25. The control member 25 is mounted for rotation about the axis 17 of the star wheels 12 and passes through the four part linkage formed by the cam arms 14, 15 and two part links 18 and 19. The control member 25 is substantially C-shaped. A manual control tether 26 is connected to the control member 25. By pulling on the control tether 26 the control member 25 can be rotated about the axis 17 bringing the control member 25 into contact with a respective one of the extended sections 18*e*, 19*e* of the two part links 18, 19. Thus, by pulling on the control tether 26 a load can be applied to a respective one of the extension sections 18*e*, 19*e* to move the device 30 from a locking condition to an unlocking condition in a similar way to a load applied along the safety lanyard parallel to the cable 11 through the connecting loop 22 as discussed above.

Figure 9A:
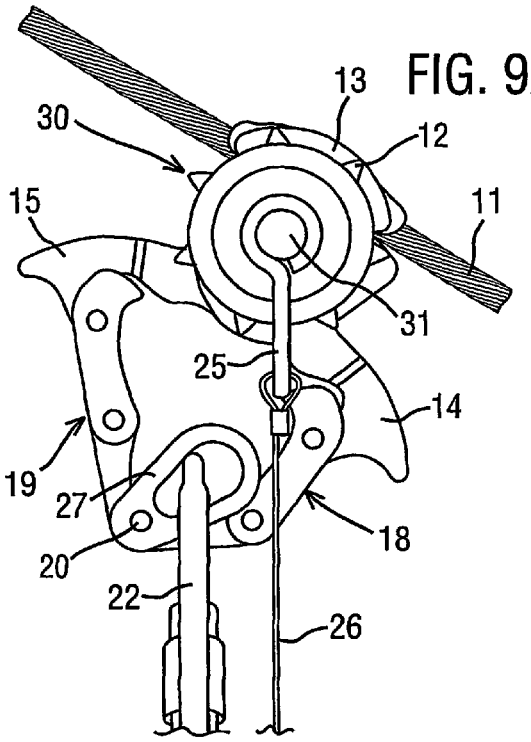
Figure 9B:
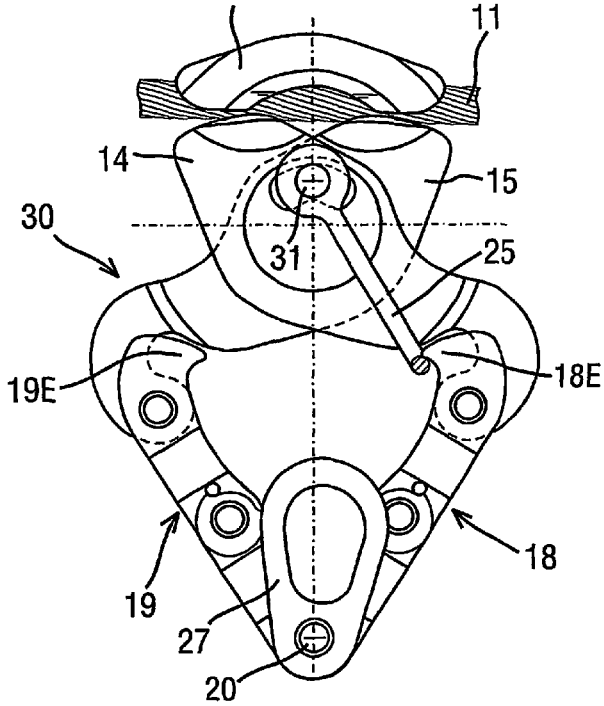
Figure 9C:
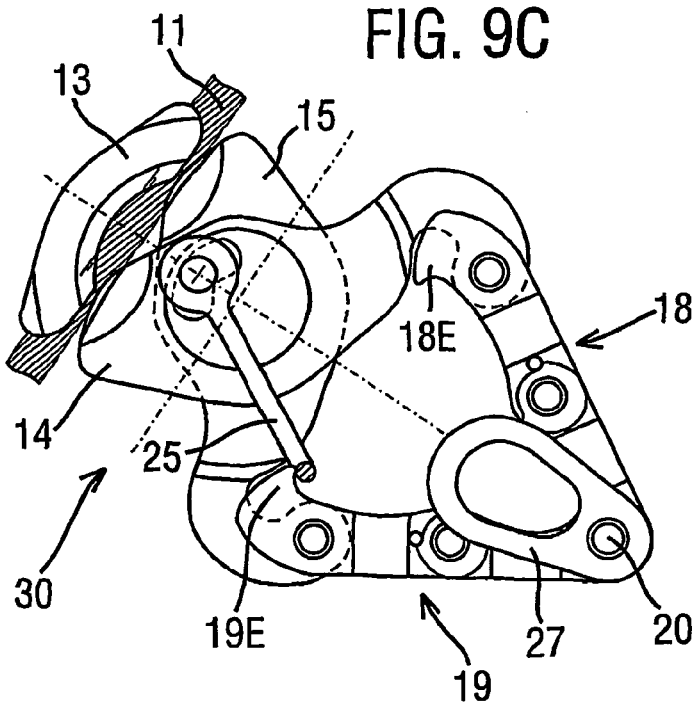
Figure 9D:
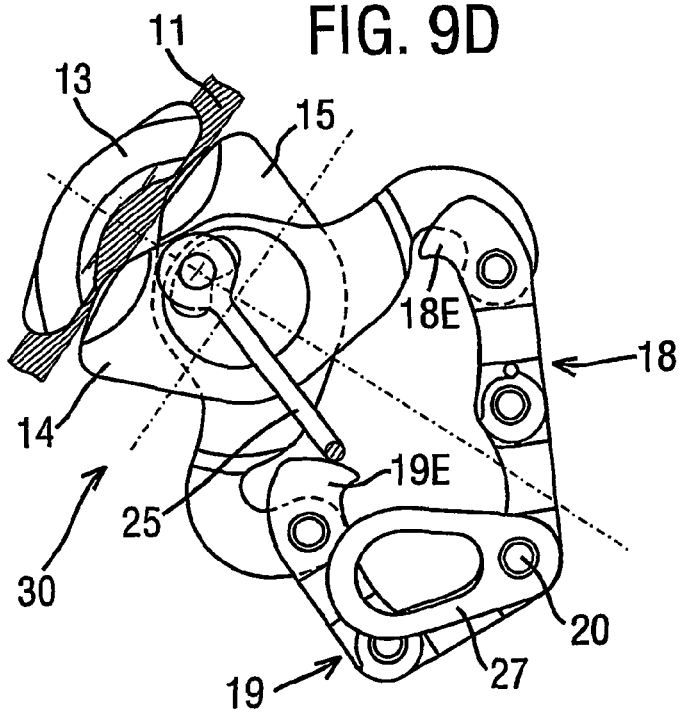

As a safety precaution, the shape of the control member 25 and the profile of the extension sections 18*e*, 19*e* are preferably arranged so that when the device 30 is subjected to a vertical load sufficiently large to buckle one of the two part links 18, 19 the resulting change in the geometry of the device 30 will move the downslope extension section 18*e*, 19*e* into a position where the contact geometry between the extension sections 18*e*, 19*e* and the control member 25 is such that loads applied along the control tether to the control member 25 cannot unlock the device 20 from the cable 11. Such an arrangement is shown in FIG. 9*d* where it can be seen that the control member 25 cannot act on the section 19*e* of the downslope two part link 19 in such a way as to unlock the device 20 from the cable 11. Such an arrangement is not essential, but it is preferred so that after a fall arrest event, so long as a vertical load greater than the threshold value required to buckle the two part links 18 and 19 is applied, pulling on the control header 26 will not unlock the device 20 from the cable 11. Clearly, unlocking the device after a fall arrest event while the user is still suspended from the device 20 could be highly dangerous.

When using the device 30 which can be locked or unlocked from the cable 11 using a remote tether, it may be desirable to limit the range of movement of the connecting loop 22 so that the device 30 can only be released from gripping the cable 21 by the control element 25 and the control tether 26 and not by loads applied along the safety lanyard. This may also be desirable where it is possible for a user to fall substantially parallel to the cable 11, in order to prevent the device 10 being unlocked by the fall loads.

One method of controlling the movement of the connecting loop 22 in this way is shown in FIG. 9 where a control tag 27 is attached for rotation about the axis 20 between the two two part links 18 and 19. The control tag 27 is a substantially oval loop and the connecting loop 22 passes through the control tag 27. The control tag 27 is sized so that it limits the movement of the connecting loop 22 to be such that it can only bear against the arm sections 18*b*, 19*b* of the respective two part links 18 and 19 and cannot pass over the axis 18*c*, 19*c* to bear on the arm sections 18*a*, 19*a*. As a result, loads applied through the safety lanyard to the connecting loop 22 can only cause the device 30 to lock onto the cable 11. The control tag 27 is free to rotate around the axis 20 so that connecting loop 22 is free to apply loads to the arm sections 18*b*, 19*b* even when the two part links 18 or 19 are buckled, as shown in FIG. 9*d*.

The operation of the device 30 is otherwise substantially the same as the operation of the device 10 of the first embodiment. However, there are further minor differences. In the device 30, a boss 28 is enclosed between the cam arms 14 and 15. Arcuate slots 29 are provided through each of the cam arms 14 and 15 through which the axle 31 passes. In this arrangement the movement of the cam arms 14 and 15 relative to one another and the boss 28 is limited by the star wheel axle 31 contacting the ends of the arcuate slots 29. Accordingly, in this embodiment the pin 23*a* and cooperating slots 14*e*, 15*e* are not required.

An alternative arrangement to provide offset axes of rotation without requiring the use of a boss would be to connect the two cam arms for mutual pivoting about an axis and to provide an arcuate slot through each cam arm extending circumferentially about the axis. If the arcuate slots overlie one another and the axle on which the star wheels rotate passes through the arcuate slots, this arrangement will allow the cam arms to pivot about an axis offset from and able to rotate about the axis of rotation of the star wheels.

The biassing of the device 10 or 30 as a whole to a gripping position and the biassing of the two part links 18 and 19 into their stopped position in which they act as substantially rigid elements is preferably carried out by a single torsion spring acting between the two links 18 and 19 about the axis 20 as shown in the embodiments. Other forms of biassing instead of a torsion spring could be used. Further, the device could be biassed into the gripping position by some other biassing arrangement such as biassing means acting directly between the two cam arms about the axis 16. However, if such biassing means is used it would be necessary to provide some further biassing means to maintain the two arm links 18, 19 in their substantially rigid orientation until a load exceeding the desired threshold was applied.

As a result, the use of passing means acting around the axis 20 between the two part links 18 and 19 is preferred because this is the only location at which a single biassing means is efficient. If biassing means is arranged elsewhere, multiple biassing means will be required.

Star wheel type devices allowing a fall arrest device to be selectively attached to or removed from a cable or other elongate support are known. The present invention could be combined with such a removable device, but for clarity, such a combination is not described herein.

It is preferred to provide for the cam arms to rotate about a common axis offset from the axis of rotation of the star wheels for the reasons set out above. However, this is not essential and the use of yielding or buckling two part links will provide the advantages set out above, even when used in a device where the cam arms and star wheels rotate about a common axis or where the cam arms rotate about different axes. Further, the use of yielding or buckling two part links can provide the advantages as set out above, even when used in a device using other known mechanisms to negotiate intermediate supports in place of a star wheel system. Finally, it is believed that an arrangement in which the cam arms rotate about a common axis offset from the axis of rotation of the star wheels will be useful in its own right for star wheel type devices even when used without the yielding or buckling two part links.

In describing the preferred embodiments the attachment of the device to a cable is referred to. The device could instead be attached to another form of elongate support such as a safety track.

The invention claimed is:

1. A fall arrest device for use on an elongate support, said device comprising:

a chassis having safety support retaining means to retain an elongate support whilst allowing movement of the device therealong, and including a sliding element for slidably engaging said elongate support;

first and second locking cam means for locking the device to the elongate support in a fall arrest situation;

first and second link means; and attaching means for attaching personal safety means to the device and transmitting a load from the personal safety means to said link means;

wherein said first and second locking cam means comprise respective first and second cam elements each arranged for rotation about a respective first axis relative to the chassis, wherein the first cam element has a first end disposed opposite a second end, the first end of the first cam element having a connection that connects the first cam element to the first link means, and the second end of the first cam element having a portion moveable between a locking position in which the portion of the first cam element traps the elongate support between itself and the sliding element and a released position in which the portion of the first cam element does not trap the elongate support, and wherein the second cam element has a first end disposed opposite a second end, the first end of the second cam element having a connection that connects the second cam element to the second link means, and the second end of the second cam element having a portion moveable between a locking position in which the portion of the second cam element traps the elongate support between itself and the sliding element and a released position in which the portion of the second cam element does not trap the elongate support;

wherein each of the first and second link means is connected to a respective second end of the first and second cam elements for rotation about a respective second axis separated from the corresponding first axis by a fixed offset defined by the respective cam element, the first and second link means being connected together for rotation about a third axis separated from said first and second axes and spaced apart from the first and second locking cam means, and the attaching means being able to move relative to the link means, so that the first and second locking cam means can be moved between their first and second positions by loads applied to the device through the attaching means; and wherein the first and second link means each include two separate and distinct parts with coupling means that provides for pivoting movement of the two parts relative to one another about a respective axis separate from the first, second and third axes, wherein the two parts pivot relative to one another in response to a downward load applied to the two parts from the attaching means such that respective portions of the two parts intermediate said second and third axes descend relative to said second axis.

2. A device as claimed in claim 1, wherein:

the cam means and link means are arranged so that said movement of the two parts of a respective link means will move at least one of said locking cam means towards its first locking position.

3. A device as claimed in claim 1, wherein:

the first and second cam elements are arranged for rotation relative to one another about a common first axis.

4. A device as claimed in claim 3, wherein:

the first and second cam elements and said common first axis are arranged for rotation about a fourth axis spaced from and parallel to the common first axis, the fourth axis being located nearer than the common first axis to the sliding element.

5. A device as claimed in claim 4, wherein:

the first and second locking cam means are arranged for rotation about a boss which is arranged for rotation about the fourth axis.

6. A device as claimed in claim 5, wherein:

the chassis means includes at least one rotatable element having a peripheral recess.

7. A device as claimed in claim 6, wherein:

the first and second cam elements and said common first axis are arranged for rotation about a fourth axis spaced from and parallel to the common first axis, the fourth axis being located nearer than the common first axis to the sliding element, and wherein the rotatable element is rotatable about the fourth axis.

8. A device as claimed in claim 1, wherein:

the first and second cam elements and first and second link means form a quadrilateral linkage defined by the first axis, the second axis for the first link means, the second axis for the second link means, and third axis, wherein the device can be configured in a first configuration and a second configuration;

wherein, in the first configuration, the first and second cam elements are in the first locking position and the first and third axes of the quadrilateral linkage are offset from one another by a first distance; and wherein, in the second configuration, the first and second cam elements are in the second released position and the first and third axes of the quadrilateral linkage are offset from one another by a second distance, the second distance being less than the first distance.

9. A device as claimed in claim 8, wherein:

the attaching means includes a loop passing around the link means so that the attaching means can transmit a load to the device by the loop bearing on a bearing surface of the link means, the bearing surface facing the interior of the quadrilateral linkage.

10. A device as claimed in claim 1, wherein:

the first and second parts of the respective link means each comprise a first arm arranged for rotation about said respective second axis and a second arm arranged for rotation about said third axis, the first and second arms being connected for rotation about a fifth axis, said reversible relative movement being rotation of the first and second arms about the said fifth axis.

11. A device as claimed in claim 10, wherein:

the attaching means includes a loop passing around the link means so that the attaching means can transmit a load to the device by the loop bearing on a concave bearing surface of the first arm of the respective link means.

12. A device as claimed in claim 10, wherein:

the attaching means includes a loop passing around the link means so that the attaching means can transmit a load to the device by the loop bearing on a concave bearing surface of the second arm of the respective link means.

13. A device as claimed in claim 10, wherein:

the attaching means includes a loop passing around the link means so that the attaching means can transmit a load to the device by the loop bearing on a bearing surface of the link means, and wherein the load applied to the bearing surface of the link means by the loop will urge at least one of the cam elements towards the first locking position.

14. A device as claimed in claim 13, further comprising:

an element limiting the movement of said loop so that it can only bear on predetermined bearing surfaces of the link means.

15. A fall arrest device for use on an elongate support, said device comprising:

a chassis having safety support retaining means to retain an elongate support whilst allowing movement of the device therealong, and including a sliding element for slidably engaging said elongate support;

first and second locking cam means for locking the device to the elongate support in a fall arrest situation;

first and second link means; and attaching means for attaching personal safety means to the device and transmitting a load from the personal safety means to said link means;

in which said first and second locking cam means comprise respective first and second cam elements each arranged for rotation about a respective first axis relative to the chassis, wherein the first cam element has a first end disposed opposite a second end, the first end of the first cam element having a connection that connects the first cam element to the first link means, and the second end of the first cam element having a portion moveable between a locking position in which the portion of the first cam element traps the elongate support between itself and the sliding element and a released position in which the portion of the first cam element does not trap the elongate support, and wherein the second cam element has a first end disposed opposite a second end, the first end of the second cam element having a connection that connects the second cam element to the second link means, and the second end of the second cam element having a portion moveable between a locking position in which the portion of the second cam element traps the elongate support between itself and the sliding element and a released position in which the portion of the second cam element does not trap the elongate support;

the first and second link means each being connected to a respective second end of the first and second cam elements for rotation about a respective second axis separated from the corresponding first axis, the first and second link means being connected together for rotation about a third axis separated from said first and second axes and spaced apart from the first and second locking cam means, and the attaching means being able to move relative to the link means, so that the first and second locking cam means can be moved between their first and second positions by loads applied to the device through the attaching means;

in which the first and second cam elements and first and second link means form a quadrilateral linkage defined by the first axis, the second axis for the first link means, the second axis for the second link means, and the third axis;

in which the device can be configured in a first configuration and a second configuration;

wherein, in the first configuration, the first and second cam elements are in the first locking position and the first and third axes of the quadrilateral linkage are offset from one another by a first distance; and wherein, in the second configuration, the first and second cam elements are in the second released position and the first and third axes of the quadrilateral linkage are offset from one another by a second distance, the second distance being less than the first distance.

16. A device as claimed in claim 15, wherein:

the first and second cam elements are arranged for rotation relative to one another about a common first axis.

17. A device as claimed in claim 16, wherein:

the first and second cam elements and said common first axis are arranged for rotation about a fourth axis spaced from and parallel to the common first axis, the fourth axis being located nearer than the common first axis to the sliding element.

18. A device as claimed in claim 17, wherein:

the first and second locking cam means are arranged for rotation about a boss which is arranged for rotation about the fourth axis.

19. A device as claimed in claim 16, wherein:

the chassis means includes at least one rotatable element having a peripheral recess.

20. A device as claimed in claim 19, wherein:

the first and second cam elements and said common first axis are arranged for rotation about a fourth axis spaced from and parallel to the common first axis, the fourth axis being located nearer than the common first axis to the sliding element, and wherein the rotatable element is rotatable about the fourth axis.

21. A device as claimed in claim 15, wherein:

the respective second axis of the first and second link means is separated from the corresponding first axis by a fixed offset defined by the respective cam element.

22. A device as claimed in claim 15, wherein:

the first and second link means each include each include two separate and distinct parts with coupling means that provides for pivoting movement of the two parts relative to one another about a respective axis separate from the first, second and third axes, wherein the two parts pivot relative to one another in response to a downward load applied to the two parts from the attaching means such that respective portions of the two parts intermediate said second and third axes descends relative to said second axis.

23. A device as claimed in claim 22, wherein:

the attaching means includes a loop passing around the link means so that the attaching means can transmit a load to the device by the loop bearing on a bearing surface of the link means, the bearing surface facing the interior of the quadrilateral linkage.

24. A device as claimed in claim 22, wherein:

the first and second parts of the respective link means comprise a first arm arranged for rotation about said respective second axis and a second arm arranged for rotation about said third axis, the first and second arms being connected for mutual rotation about a fifth axis.

* * * * *